US009145897B2

(12) United States Patent
Wu

(10) Patent No.: US 9,145,897 B2
(45) Date of Patent: Sep. 29, 2015

(54) BLADE STRUCTURE FOR CENTRIFUGAL FAN

(75) Inventor: Chun-Ming Wu, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 598 days.

(21) Appl. No.: 13/253,045

(22) Filed: Oct. 4, 2011

(65) Prior Publication Data

US 2013/0084187 A1 Apr. 4, 2013

(51) Int. Cl.
*F04D 25/16* (2006.01)
*F04D 29/30* (2006.01)
*F04D 29/28* (2006.01)

(52) U.S. Cl.
CPC ..... *F04D 25/166* (2013.01); *F04D 29/281* (2013.01); *F04D 29/30* (2013.01)

(58) Field of Classification Search
CPC ... F04D 25/166; F04D 29/242; F04D 29/281; F04D 29/28; F04D 29/30; F04D 29/38; F04D 29/384
USPC ..... 415/93, 97, 98, 99, 100, 101, 102, 103; 416/175, 182, 183, 203
See application file for complete search history.

(56) References Cited

U.S. PATENT DOCUMENTS

| | | | | |
|---|---|---|---|---|
| 7,125,226 | B2 * | 10/2006 | Horng et al. | 416/203 |
| 7,918,651 | B2 * | 4/2011 | Jiang et al. | 416/203 |
| 2002/0057965 | A1 * | 5/2002 | Huang et al. | 415/98 |
| 2005/0191174 | A1 * | 9/2005 | Zeng et al. | 415/206 |
| 2009/0162198 | A1 * | 6/2009 | Ogino et al. | 416/9 |
| 2013/0011247 | A1 * | 1/2013 | Liu | 415/198.1 |

* cited by examiner

*Primary Examiner* — Edward Look
*Assistant Examiner* — Danielle M Christensen

(57) ABSTRACT

A blade structure for centrifugal fan includes a hub, a first blade unit, and a second blade unit. The hub has a connection section formed therearound and the connection section has a first side and an opposite second side. The first and the second blade unit are radially outward extended from the first and the second side, respectively, of the connection section. By providing the first and the second blade unit around the hub of a centrifugal fan, the air flows and air pressure produced by the centrifugal fan can be largely increased at effectively reduced noise.

7 Claims, 9 Drawing Sheets

BLADE STRUCTURE FOR CENTRIFUGAL FAN

FIELD OF THE INVENTION

The present invention relates to a blade structure for centrifugal fan, and more particularly to a blade structure that includes two levels of blades arranged around a hub of a centrifugal fan to enable the centrifugal fan to provide enhanced air guiding and pressurizing effects.

BACKGROUND OF THE INVENTION

With the quickly developed electronic industrial field, the currently available electronic elements have constantly upgraded performance and accordingly, very fast computing speed. As a result, a large amount of heat is generated by the electronic elements during the high-speed operation thereof. The large amount of heat must be timely removed from the electronic elements to protect the electronic elements against lowered operational performance or even burnout. Therefore, a small-size centrifugal fan is usually utilized in the limited space of an electronic product for removing heat therefrom. The centrifugal fan mainly includes a frame, a hub, and a plurality of blades externally spaced along the hub. The frame defines at an upper and a lower side with an air-in opening each, and at one lateral side with an air-out opening. When the centrifugal fan operates, the blades rotate to cause ambient air to flow. Air axially flows into the frame via the upper and lower air-in openings is guided by the blades to flow in a radial direction of the hub and out of the centrifugal fan via the air-out opening.

To produce higher air pressure and more air flows, fan manufacturers have made efforts to change the shape of the blades. However, the effects of increased pressure and air flow that can be obtained via modification of blade shapes are limited and fail to satisfy general users' demands. Further, since the centrifugal fan has a relatively small frame, which also limits the possible change of the blades in shape. In brief, the blades for the conventional centrifugal fan have the following disadvantages: (1) being limited in the structural design thereof; (2) providing only limited pressurizing effect; (3) having relatively poor air guiding efficiency; and (4) producing relatively high noise.

SUMMARY OF THE INVENTION

A primary object of the present invention is to provide a blade structure that enables a centrifugal fan to provide increased air flows and air pressure at reduced noise.

To achieve the above and other objects, the blade structure for centrifugal fan according to the present invention includes a hub, a first blade unit, and a second blade structure.

The hub has a connection section formed therearound, and the connection section has a first side and an opposite second side. The first blade unit radially outward extends from the first side of the connection section of the hub, and includes a plurality of first blades. The first blades is arranged on and spaced along the first side of the connection section. The second blade unit radially outward extends from the second side of the connection section of the hub, and includes a plurality of second blades. The second blades are arranged on and spaced along the second side of the connection section.

The first and the second blade unit constitute a bidirectional pressurizing structure for a centrifugal fan to have largely increased air guiding efficiency and enhanced pressurization and noise reduction effects.

In brief, the present invention has the following advantages: (1) providing increased air flows; (2) providing good air guiding efficiency; (3) providing increased air pressure; (4) producing good pressurization effect; and (5) enabling noise reduction.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
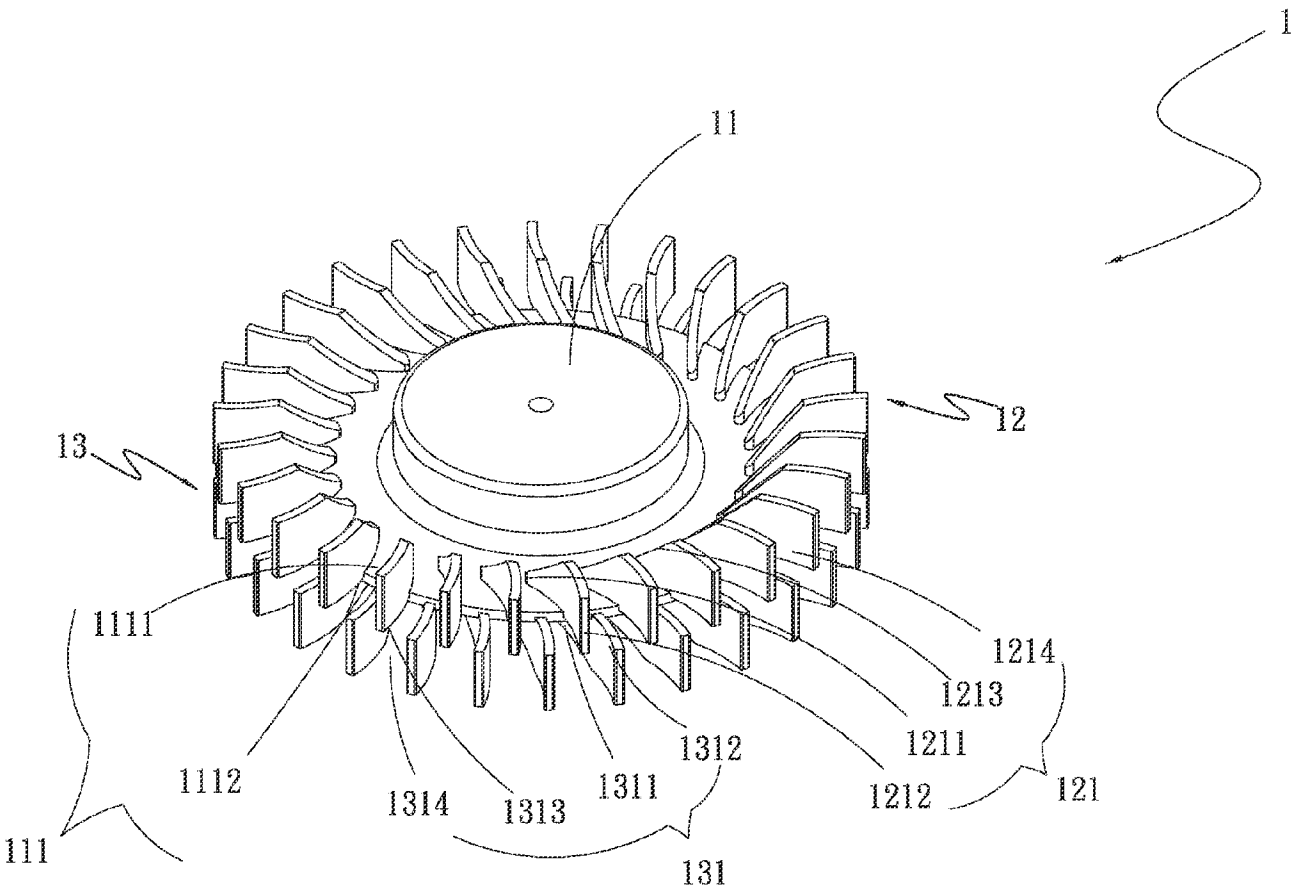
FIG. 1 is a perspective view of a blade structure for centrifugal fan according to a first embodiment of the present invention.

The present invention will now be described with some preferred embodiments thereof and with reference to the accompanying drawings. For the purpose of easy to understand, elements that are the same in the preferred embodiments are denoted by the same reference numerals.

Figure 2:
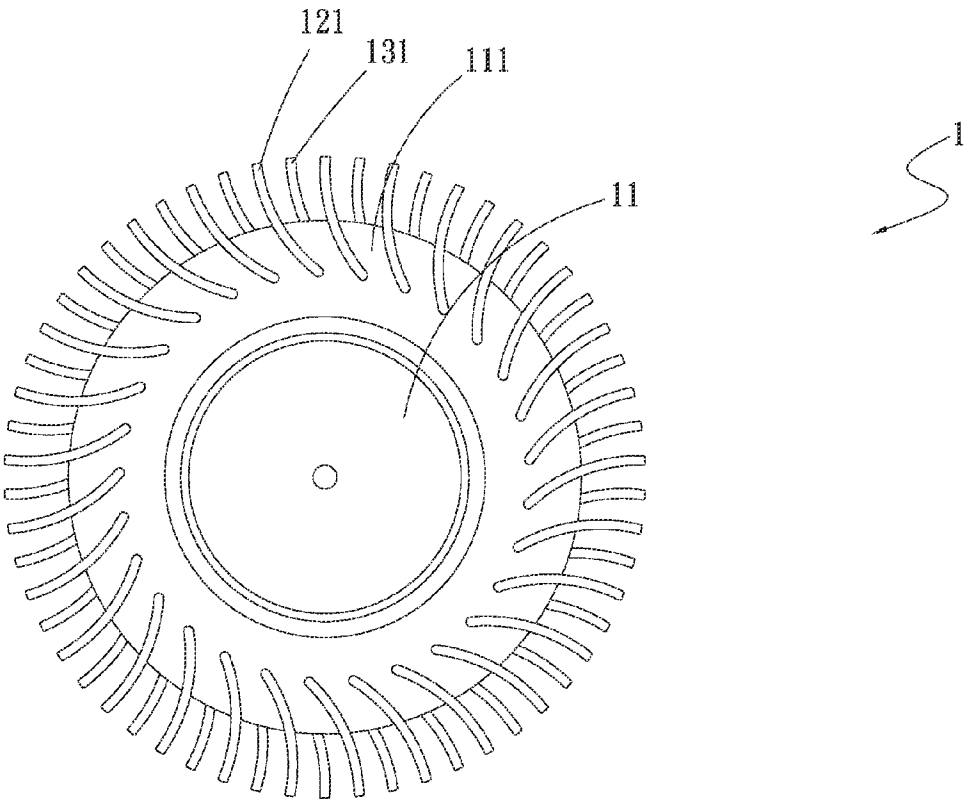
FIG. 2 is a top view of FIG. 1.

Please refer to FIGS. 1 and 2 that are perspective and top views, respectively, of a blade structure for centrifugal fan according to a first embodiment of the present invention. For the purpose of conciseness, the present invention is also briefly referred to as "the blade structure" herein and is generally denoted by reference numeral 1. As shown, in the first embodiment, the blade structure 1 includes a hub 11, a first blade unit 12, and a second blade unit 13.

The hub 11 includes a connection section 111 formed therearound. The connection section 111 has a first side 1111 and an opposite second side 1112 corresponding to an upper and a lower side thereof, respectively.

The first blade unit 12 is radially outward extended from the first side 1111 of the connection section 111, and includes a plurality of first blades 121 arranged on and spaced along the first side 1111 of the connection section 111.

The second blade unit 13 is radially outward extended from the second side 1112 of the connection section 111, and includes a plurality of second blades 131 arranged on and spaced along the second side 1112 of the connection section 111.

The first blades 121 respectively include a first end 1211 and an opposite second end 1212. The first ends 1211 respectively have a first recess 1213 formed thereat and are connected to the connection section 111. The second blades 131 respectively have a third end 1311 and an opposite fourth end

1312. The third ends 1311 respectively have a second recess 1313 formed thereat and are connected to the connection section 111. Any two adjacent ones of the first blades 121 define a first flow passage 1214 between them; and any two adjacent ones of the second blades 131 define a second flow passage 1314 between them.

Figure 3:
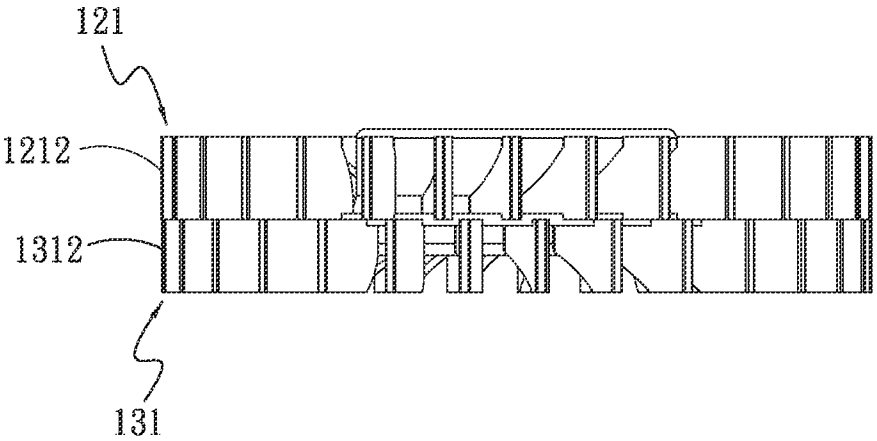
FIG. 3 is a side view of a blade structure for centrifugal fan according to a second embodiment of the present invention.

Please refer to FIG. 3 that is a side view of a blade structure for centrifugal fan according to a second embodiment of the present invention. As shown, the second embodiment is generally structurally similar to the first embodiment, except that a height of the first blades 121 at the second end 1212 thereof is larger than a height of the second blades 131 at the fourth end 1312 thereof.

Figure 4:
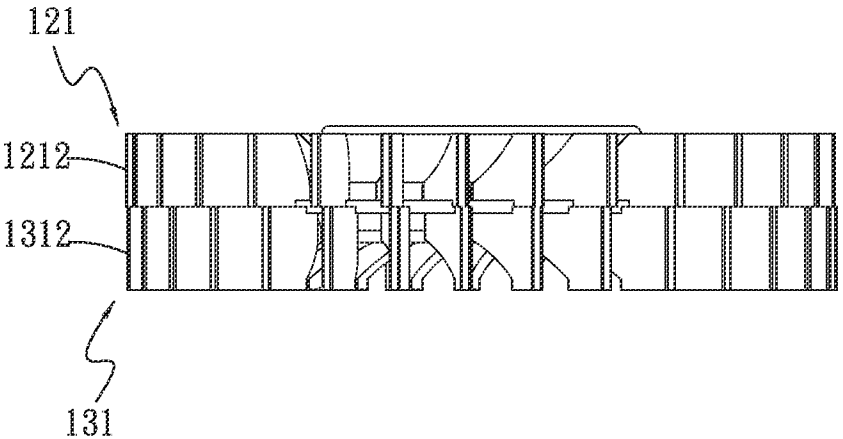
FIG. 4 is a side view of a blade structure for centrifugal fan according to a third embodiment of the present invention.

FIG. 4 is a side view of a blade structure for centrifugal fan according to a third embodiment of the present invention. As shown, the third embodiment is generally structurally similar to the first embodiment, except that a height of the first blades 121 at the second end 1212 thereof is smaller than a height of the second blades 131 at the fourth end 1312 thereof.

Figure 5:
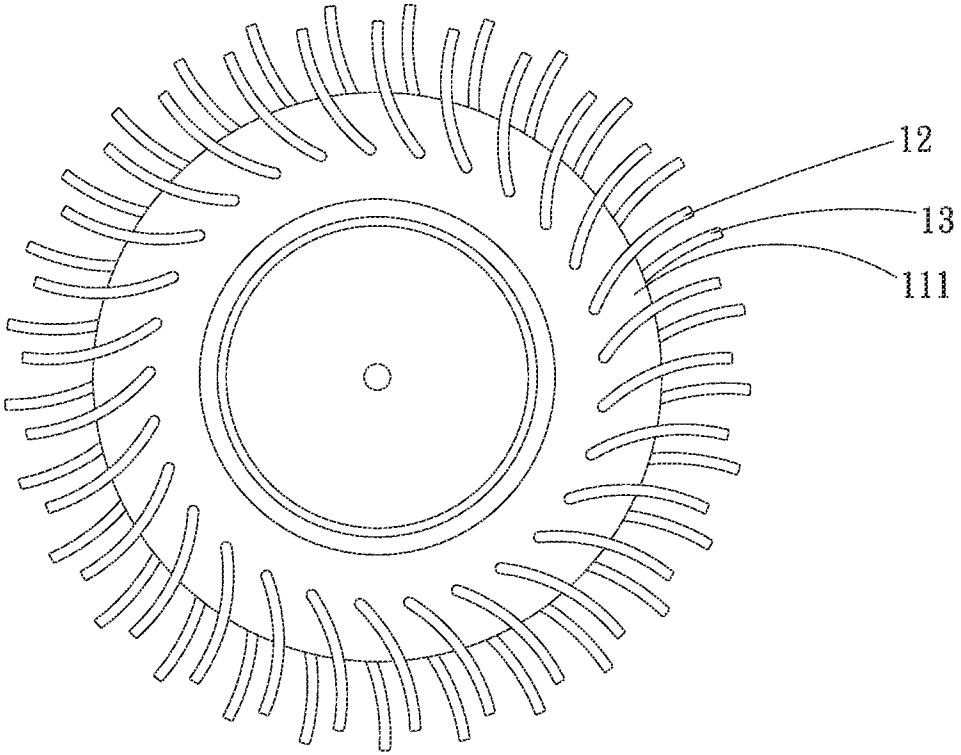
FIG. 5 is a top view of a blade structure for centrifugal fan according to a fourth embodiment of the present invention.

FIG. 5 is a top view of a blade structure for centrifugal fan according to a fourth embodiment of the present invention. As shown, the fourth embodiment is generally structurally similar to the first embodiment, except that a length by which the first blade unit 12 radially outward extends from the connection section 111 is shorter than a length by which the second blade unit 13 radially outward extends from the connection section 111.

Figure 6:
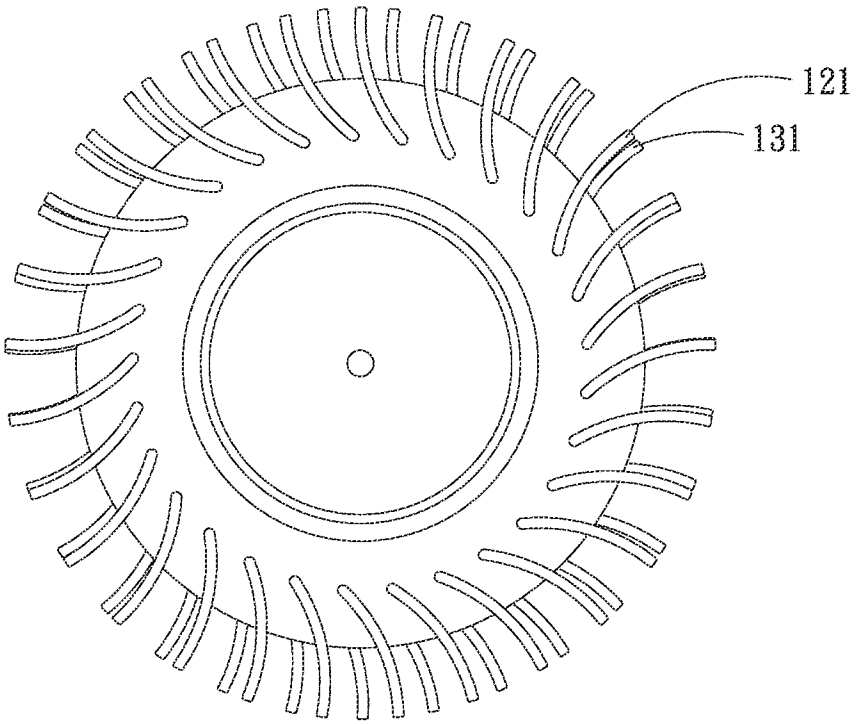
FIG. 6 is a top view of a blade structure for centrifugal fan according to a fifth embodiment of the present invention.

FIG. 6 is a top view of a blade structure for centrifugal fan according to a fifth embodiment of the present invention. As shown, the fifth embodiment is generally structurally similar to the first embodiment, except that the first blades 121 and the second blades 131 are different in number. While the number of the first blades 121 in the illustrated fifth embodiment is smaller than that of the second blades 131, it is understood the present invention is not necessarily limited thereto and the number of the first blades 121 may be otherwise larger than that of the second blades 131.

Figure 7:
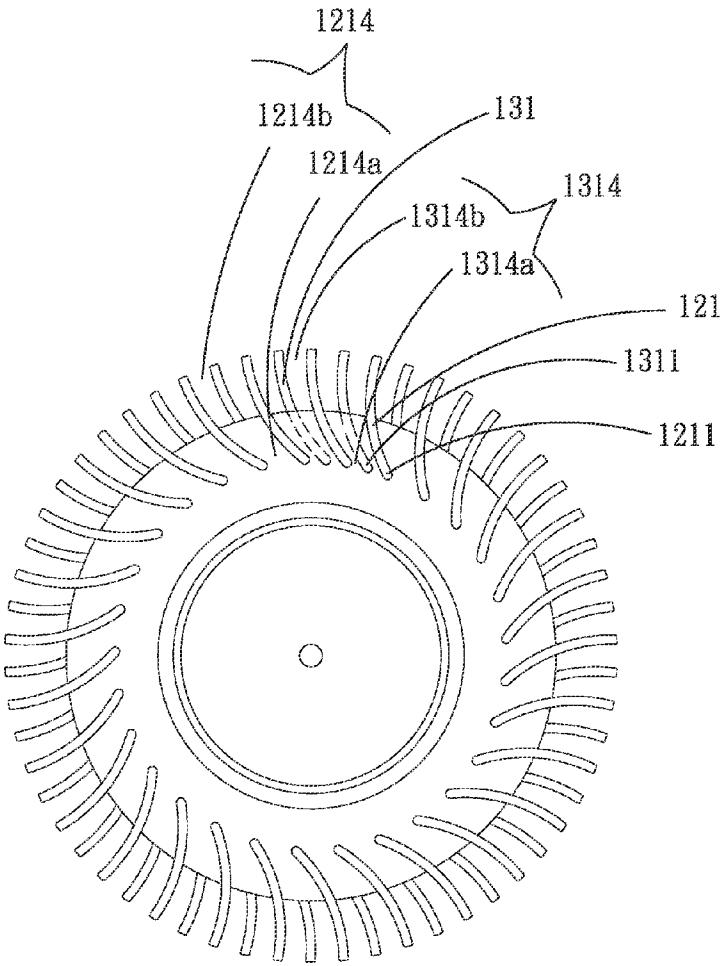
FIG. 7 is a top view of a blade structure for centrifugal fan according to a sixth embodiment of the present invention.

Please refer to FIG. 7 that is a top view of a blade structure for centrifugal fan according to a sixth embodiment of the present invention. As shown, the sixth embodiment is generally structurally similar to the first embodiment, except that the first ends 1211 of the first blades 121 and the third ends 1311 of the second blades 131 are not correspondingly located on the connection section 111 but are arranged on the first and the second side 1111, 1112 of the connection section 111, respectively, in staggered relation. More specifically, the first flow passage 1214 defined between any two adjacent first blades 121 has a first air-in end 1214*a* and a first air-out end 1214*b*; and the second flow passage 1314 defined between any two adjacent second blades 131 has a second air-in end 1314*a* and a second air-out end 1314*b*. And, in the sixth embodiment of the present invention, the first air-in ends 1214*a* and the second air-in ends 1314*a* are not correspondingly located on the connection section 111 but are arranged on the first and the second side 1111, 1112 of the connection section 111, respectively, in staggered relation.

Figure 8:
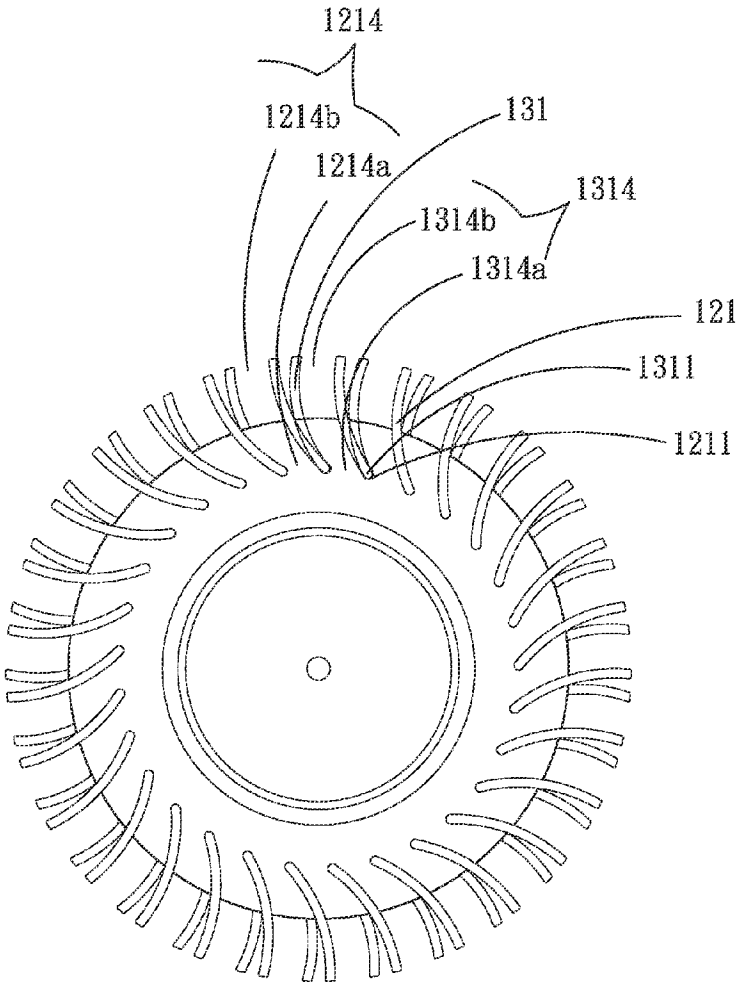
FIG. 8 is a top view of a blade structure for centrifugal fan according to a seventh embodiment of the present invention.

Please refer to FIG. 8 that is a top view of a blade structure for centrifugal fan according to a seventh embodiment of the present invention. As shown, the seventh embodiment is generally structurally similar to the sixth embodiment, except that the first ends 1211 of the first blades 121 and the third ends 1311 of the second blades 131 are correspondingly located on the connection section 111, and accordingly, the first air-in ends 1214*a* and the second air-in ends 1314*a* are correspondingly arranged along the connection section 111.

Figure 9:
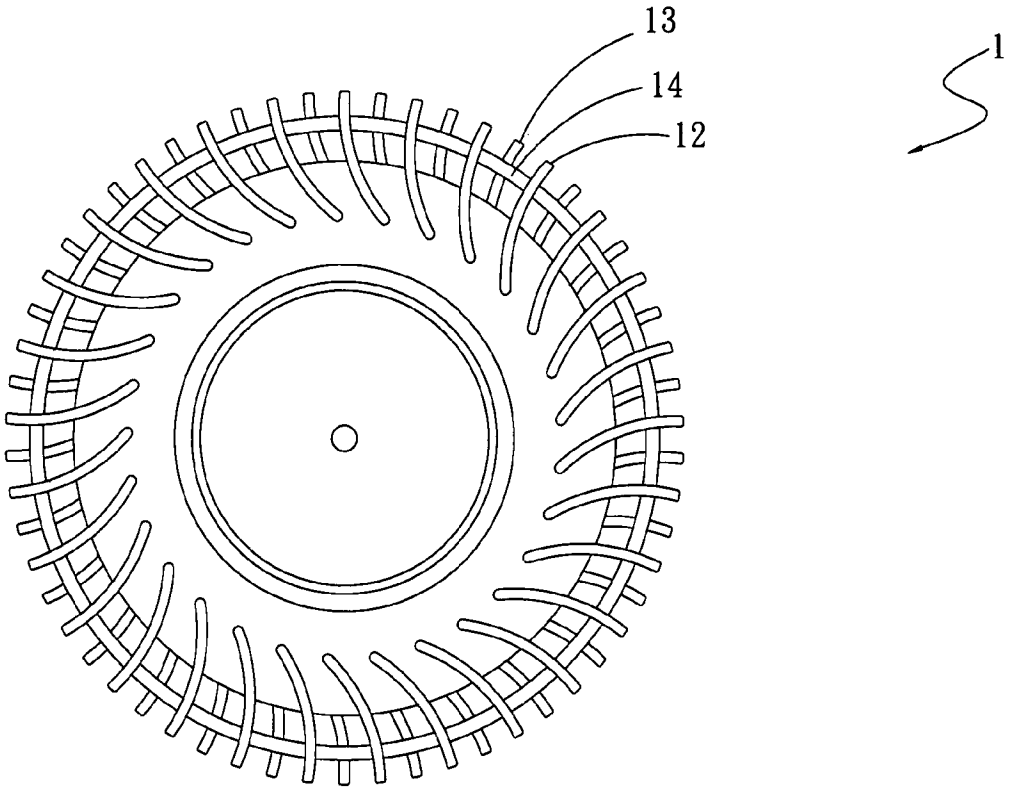
FIG. 9 is a top view of a blade structure for centrifugal fan according to an eighth embodiment of the present invention.

FIG. 9 is a top view of a blade structure for centrifugal fan according to an eighth embodiment of the present invention. As shown, the eighth embodiment is generally structurally similar to the first embodiment, except for a ring member 14 that is connected to between the first blade unit 12 and the second blade unit 13 for increasing an overall structural strength of the blade structure 1 of the present invention.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A blade structure for centrifugal fan, comprising:

a hub having a connection section formed therearound, and the connection section having a first side and an opposite second side;

a first blade unit radially outward extending from the first side of the connection section of the hub, and including a plurality of first blades; and the first blades being arranged on and spaced along the first side of the connection section;

a second blade unit radially outward extending from the second side of the connection section of the hub, and including a plurality of second blades; and the second blades being arranged on and spaced along the second side of the connection section; and wherein the first blades respectively have a first end and an opposite second end; the first ends being proximal ends and corresponding to the hub; the second ends being distal ends; the first ends further respectively having a first recess formed thereat and being connected to the connection section; a surface of the first blades being gradually increased for a distance that is less than the full distance from the first end to the second end to define the first recess between the first and the second ends wherein the second blades respectively have a third end and an opposite fourth end; the third ends being proximal ends and corresponding to the hub; the fourth ends being distal ends; the third ends further respectively having a second recess formed thereat and being connected to the connection section; a surface of the second blade being gradually increased for a distance that is less than the full distance from the third end to the fourth end to define the second recess between the third and the fourth ends;

wherein any two adjacent ones of the first blades define a first flow passage therebetween, and any two adjacent ones of the second blades define a second flow passage therebetween; and wherein the first ends of the first blade unit correspond circumferentially to the third ends of the second blade unit, but the second ends of the first blade unit do not correspond and differ circumferentially from the fourth ends of the second blade unit.

2. The blade structure for centrifugal fan as claimed in claim 1, wherein a height of the first blades at the second ends is larger than a height of the second blades at the fourth ends.

3. The blade structure for centrifugal fan as claimed in claim 1, wherein a height of the first blades at the second ends is smaller than a height of the second blades at the fourth ends.

4. The blade structure for centrifugal fan as claimed in claim 1, wherein the first and the second side of the connection section correspond to an upper and a lower side of the connection section, respectively.

5. The blade structure for centrifugal fan as claimed in claim 1, wherein the first blade unit radially outward extends from the connection section by a length, which is shorter than a length by which the second blade unit radially outward extends from the connection section.

6. The blade structure for centrifugal fan as claimed in claim 1, wherein the first and the second blades are the same in number.

7. The blade structure for centrifugal fan as claimed in claim 1, wherein the first ends and the third ends are correspondingly connected to the first and the second side of the connection section, respectively; and wherein the first flow passages respectively have a first air-in end and a first air-out end, and the second flow passages respectively have a second air-in end and a second air-out end; and the first air-in ends and the second air-in ends are correspondingly arranged along the first and the second side of the connection section, respectively.

* * * * *